US006763776B1

(12) United States Patent
Perri et al.

(10) Patent No.: US 6,763,776 B1
(45) Date of Patent: Jul. 20, 2004

(54) CLEAT DEVICE FOR A FLEXIBLE LINE AND METHOD OF USING SAME

(75) Inventors: Michael D. Perri, 10930 47th Ave. North, Plymouth, MN (US) 55442; Bryon M. Suter, Plymouth, MN (US)

(73) Assignees: Industrial Sales Corporation, Westport, CT (US); Michael D. Perri, Plymouth, MN (US)

( * ) Notice: Subject to any disclaimer, the term of this patent is extended or adjusted under 35 U.S.C. 154(b) by 0 days.

(21) Appl. No.: 10/611,356

(22) Filed: Jun. 30, 2003

(51) Int. Cl.[7] ..... B63B 21/04
(52) U.S. Cl. ..... 114/218; 24/129 R
(58) Field of Search ..... 114/218; 24/129 R; D8/356

(56) References Cited

U.S. PATENT DOCUMENTS

| | | | | | |
|---|---|---|---|---|---|
| 556,485 | A | * | 3/1896 | Wilson | 24/129 R |
| D209,330 | S | * | 11/1967 | Coderre et al. | D8/382 |
| 4,120,077 | A | | 10/1978 | Fink | |
| 4,373,463 | A | * | 2/1983 | Beaudette | 114/218 |
| D287,097 | S | | 12/1986 | Nelson | |
| 5,193,252 | A | * | 3/1993 | Svehaug | 24/115 G |
| 5,245,729 | A | * | 9/1993 | Greff | 24/129 R |
| 5,519,921 | A | * | 5/1996 | Templer, Jr. | 24/130 |
| 6,094,783 | A | * | 8/2000 | Parsons | 24/130 |

OTHER PUBLICATIONS

Brochure of Industrial Sales Corporation for "Grip–Tite" (when it comes to bay and bow window units . . . ), undated.
Brochure of Industrial Sales Corporation for "Grip–Rite" (the original industry trusted cable systems . . . ), undated.

* cited by examiner

*Primary Examiner*—Jesus D. Sotelo
(74) *Attorney, Agent, or Firm*—Barry R. Lipsitz

(57) ABSTRACT

The present invention relates to a cleat device for a flexible line and methods for cleating a flexible line. In an example embodiment of the invention, a cleat device for a flexible line is provided. The cleat device includes a base adapted for mounting on a surface. A plurality of spaced apart jam cleats are arranged on the base. Each jam cleat may have at least one open end forming an acute angle. A projection may extend from each end of the base outside of the plurality of jam cleats. A portion of at least one of the projections may extend above the jam cleats and may have a bore therethrough. A cleating method for use with the inventive cleating device is also provided.

24 Claims, 4 Drawing Sheets

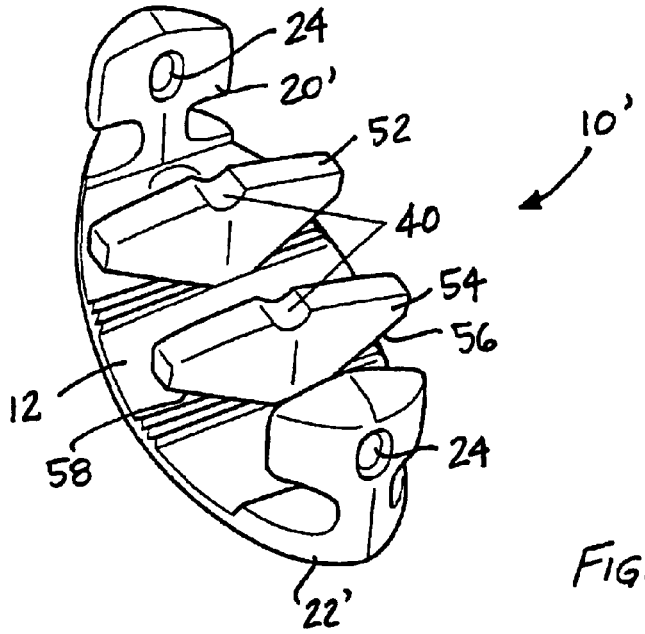
FIG. 5
FIG. 6
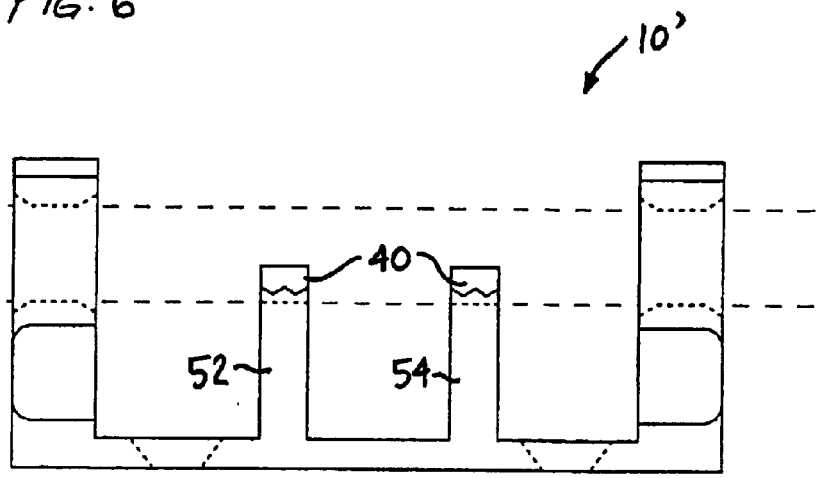

CLEAT DEVICE FOR A FLEXIBLE LINE AND METHOD OF USING SAME

BACKGROUND OF THE INVENTION

The present invention relates to a cleat device for securely fastening a flexible line, such as a rope or a cable. More specifically, the present invention relates to a cleat device having a plurality of jam cleats and end projections having a bore therethrough to secure the tag end (i.e. the bitter end) of the flexible line.

A prior art cleat device is disclosed in U.S. Pat. No. 4,373,463 to Beaudette. The Beaudette patent discloses a cleat device having at least three jam cleats mounted on a base in juxtaposition with adjacent open ends of the jam cleats facing in the opposite directions. At the outer ends of the base, Beaudette provides hooks as a means for retaining the flexible line in position in the jam cleats.

With cleat devices such as those disclosed in the Beaudette patent, the tag end of the line is subject to movement caused by the wind (e.g., when the cleat device is exposed to weather on a dock, or mounted on a moving vehicle). Such movement may cause loosening of the line.

Cleat devices such as those described in the Beaudette patent are also used to secure cantilevered window assemblies. When used in such assemblies, the tag end of the line is normally stapled or tacked to the beam on which the cleat is mounted. Such tacking or nailing comprises an extra time consuming step in the cleating process, and requires additional hardware and tools to be used.

It would be advantageous to provide a cleat device having a means for securing the tag end of the flexible line. It would be further advantageous if such means for securing the flexible line was a part of the cleat device, such that no additional hardware or tools were required after the cleat is mounted in place.

The apparatus and methods of the present invention provide the foregoing and other advantages.

SUMMARY OF THE INVENTION

The present invention relates to a cleat device for a flexible line and methods for cleating a flexible line. In an example embodiment of the invention, a cleat device for a flexible line is provided. The cleat device includes a base adapted for mounting on a surface. A plurality of spaced apart jam cleats are arranged on the base. Each jam cleat may have at least one open end forming an acute angle. A projection may extend from each end of the base outside of the plurality of jam cleats. A portion of at least one of the projections may extend above the jam cleats and may have a bore therethrough.

An example embodiment of the inventive method of cleating a flexible line comprises:

(a) guiding the flexible line around a first projection extending from a first end of a cleat base;

(b) guiding the flexible line from the first projection around open ends of a plurality of spaced apart jam cleats arranged successively on the base, the open ends forming an acute angle;

(c) guiding the flexible line from a last successive jam cleat around a second projection extending from a second end of the cleat base; and (d) inserting the flexible line through a bore in at least one of the projections which extends above the jam cleats;

wherein the line is guided at an angle between opposite ends of: (i) the first projection and a first jam cleat; (ii) each successive jam cleat; and (iii) the last successive jam cleat and the second projection.

BRIEF DESCRIPTION OF THE DRAWINGS

The present invention will hereinafter be described in conjunction with the appended drawing figures, wherein like numerals denote like elements, and:

FIG. 5 shows a perspective view of a further example embodiment of a cleat device in accordance with the invention;

FIG. 6 shows a side view of the cleat device of FIG. 5;

DETAILED DESCRIPTION OF THE INVENTION

Figure 1:
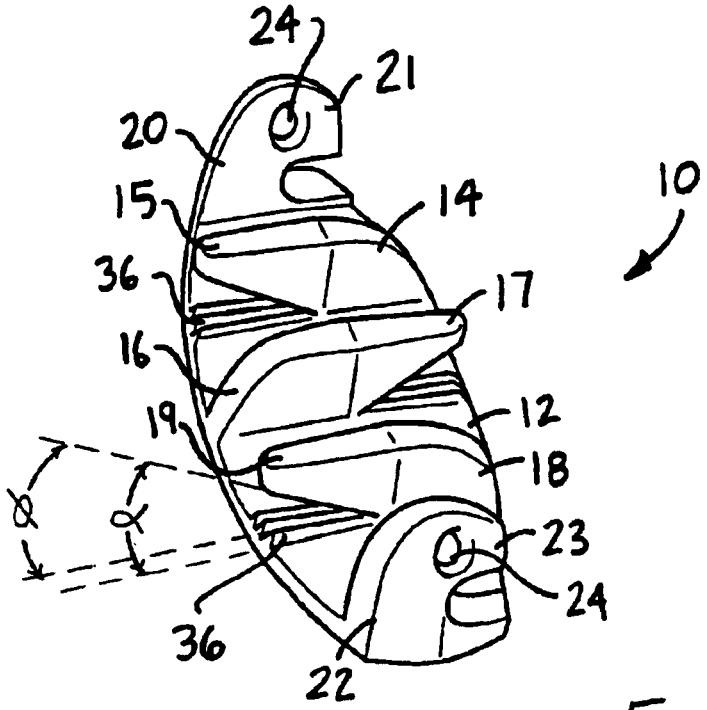
FIG. 1 shows a perspective view of an example embodiment of a cleat device in accordance with the invention.
Figure 2:
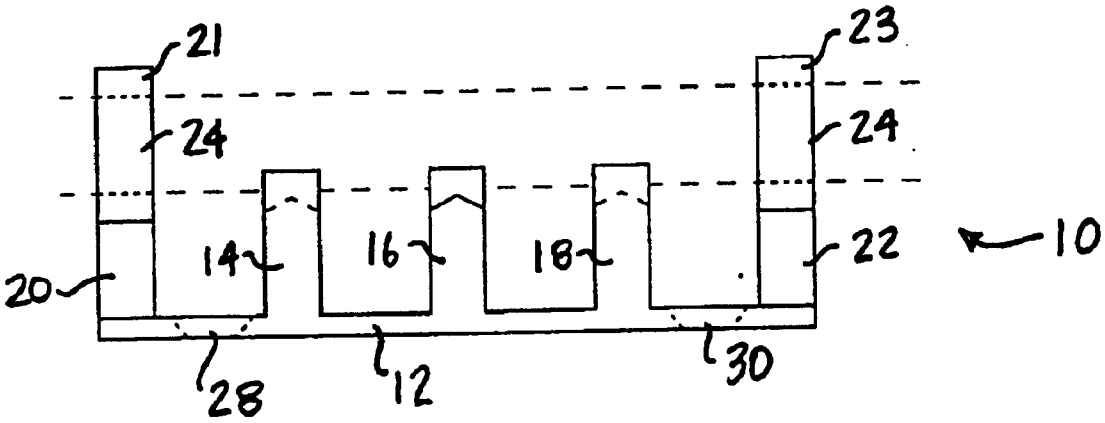
FIG. 2 shows a side view of the cleat device of FIG. 1.

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

In an example embodiment of the invention as shown in FIGS. 1–4 , a cleat device 10 for a flexible line 50 is provided. The cleat device 10 includes a base 12 adapted for mounting on a surface. A plurality of spaced apart jam cleats 14, 16, 18 are arranged on the base 12. Each jam cleat 14, 16, 18 may have at least one open end 15, 17, 19 forming an acute angle with the base 12 (e.g., such as angle a shown at open end 19 of FIG. 1). A projection 20, 22 may extend from each end of the base 12 outside of the plurality of jam cleats 14, 16, 18. A portion 21, 23 (FIG. 2) of at least one of the projections 20, 22 may extend above the jam cleats 14, 16, 18 and may have a bore 24 or similar opening therethrough. For example, instead of a bore, an open channel, a slot, or another opening may be provided.

FIGS. 1–4 show cleat device 10 as having three jam cleats 14, 16, and 18, for purposes of explanation only. Those skilled in the art will appreciate that the inventive cleat device 10 may have two or more jam cleats.

The cleat device 10 may be mounted on any flat surface, such as a dock, a truck bed, a wall, a beam, or the like. Holes 28, 30 (FIG. 2) may be provided in the base 12 for mounting the cleat device 10 to a surface using screws, nails, or other fastening means.

The flexible line 50 may comprise a rope or cable of any material, provided it is flexible. Such materials include but are not limited to cotton, nylon, wire, plastic coated wire, hemp, sisal, synthetic materials, and the like.

In an example embodiment where each of the jam cleats 14, 16, and 18 has one open end, the open ends 15, 17, 19 of adjacent jam cleats may be arranged opposite each other. The acute angle $\alpha$ of the open end of the jam face may be in the range of approximately 10 to 50 degrees. In an alternate embodiment, the acute angle a may be in the range of approximately 15 to 30 degrees.

In a further example embodiment of the invention, each of the projections 20, 22 may comprise a hook-shaped arm. The hook-shaped arm assists in retaining the line in position in the first and last jam cleats (e.g., jam cleats 14 and 18).

Figure 3:
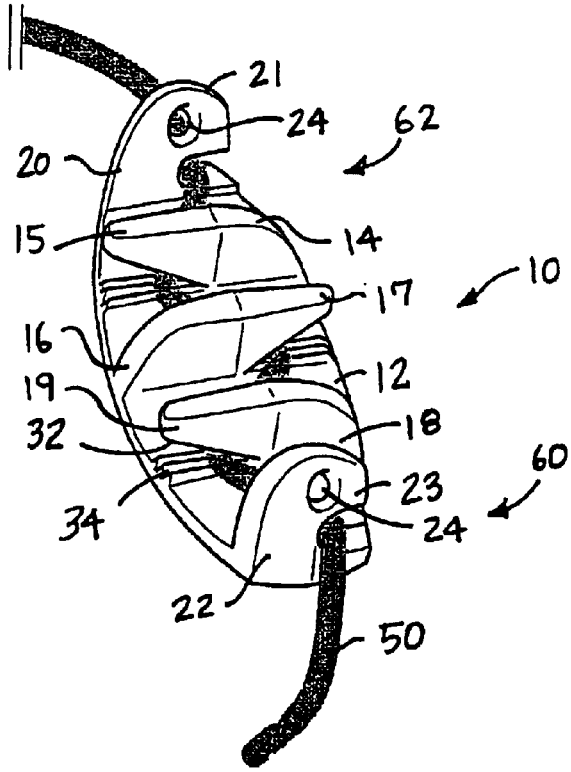
FIG. 3 shows a perspective view of the cleat device of FIG. 1 with a flexible line guided therethrough.
Figure 4:
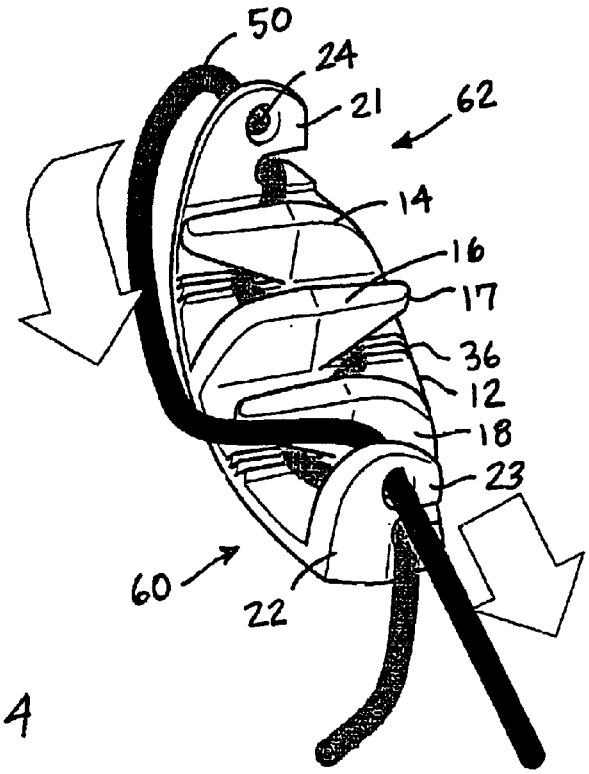
FIG. 4 shows a further perspective view of the cleat device of FIG. 1 with a flexible line guided therethrough.

The open end 15, 17, 19 of each jam cleat 14, 16, 18 forming the acute angle $\alpha$ may comprise an upper face and a lower face (for example upper face 32 and lower face 34 of open end 19 of jam cleat 18 of FIG. 3). The upper and lower faces 32, 34 of the open end of each jam cleat 14, 16, 18 are adapted to impinge on a flexible line 50 passed therethrough.

At least one of the upper face 32 or the lower face 34 may include at least one ridge 36 thereon. The ridge(s) 36 on each face 32, 34 may form a second acute $\phi$ angle with the opposite face or with a corresponding ridge on the opposite face. The second acute angle $\phi$ is necessarily smaller than the first acute angle a formed by the open ends of the jam cleats. In such an embodiment, a flexible line 50 passed through the open end 15, 17, 19 of the jam cleat will be impinged, not only by the upper and lower faces 32, 34 of the open end, but also by peaks of the ridge(s) 36 on the upper and/or lower face.

An alternate example embodiment of a cleat device 10' is shown in FIGS. 5–8. The jam cleats 52, 54 may have two open ends (e.g., open ends 56, 58 of jam cleat 54 and open ends 51, 53 of jam cleat 52) which form acute angles. The plurality of jam cleats may comprise two jam cleats as shown in FIGS. 5–8. Alternatively, the plurality of jam cleats may comprise at least three jam cleats.

The cleat device 10' may further comprise recesses 40 in a top portion of the jam cleats which are approximately aligned with the bore 24. The recesses 40 may be, for example, semi-circular.

The jam cleats may be arranged in parallel with each other on the base 12. However, other arrangements that are not parallel are also envisioned in accordance with the invention.

In a further example embodiment of the inventive cleat device, the cleat device 10 or 10' may be adapted for use in securing a cable support for one of a bay window or a bow window.

Figure 7:
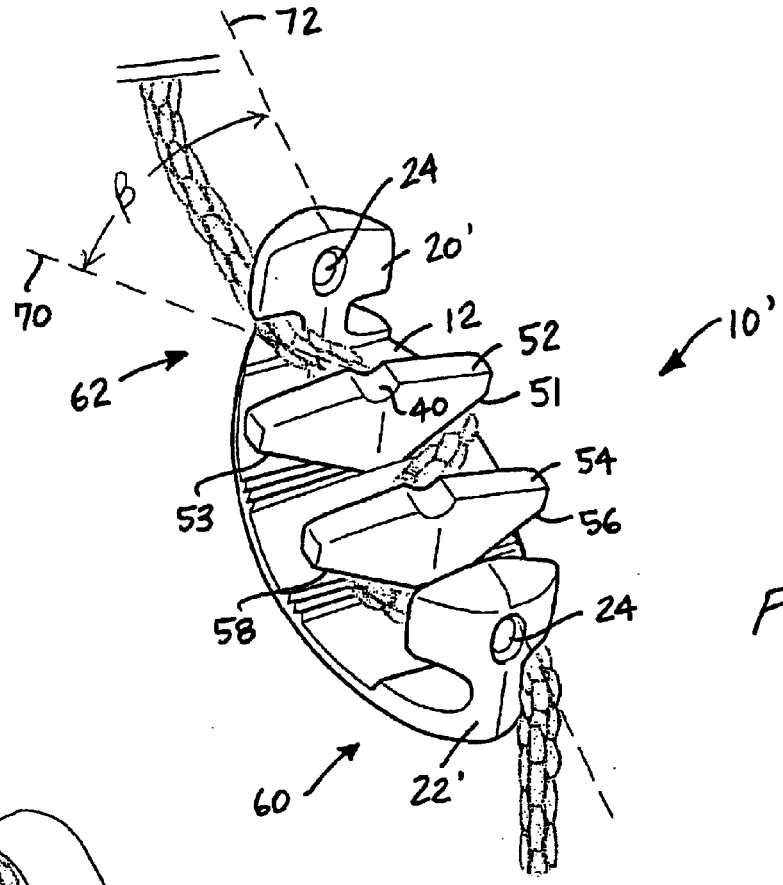
FIG. 7 shows a perspective view of the cleat device of FIG. 5 with a flexible line guided therethrough.

A method for cleating a flexile line is also provided in accordance with the invention, and is illustrated in FIGS. 3, 4, 7, and 8. An example embodiment of the inventive method may comprise:

(a) guiding the flexible line 50 around a first projection 22, 22' extending from a first end 60 of a cleat base 12;

(b) guiding the flexible line 50 from the first projection 22, 22' around open ends (e.g., open ends 19, 17, and 15 of FIG. 3, and open ends 58, 53 of FIG. 7) of a plurality of spaced apart jam cleats arranged successively on the base 12, the open ends forming an acute angle $\alpha$;

(c) guiding the flexible line 50 from a last successive jam cleat 14, 52 around a second projection 20, 20' extending from a second end 62 of the cleat base 12; and (d) inserting the flexible line 50 through a bore 24 in at least one of the projections 20, 22 or 20', 22' which extends above the jam cleats;

wherein the line 50 is guided at an angle (e.g., angle $\beta$ as shown in FIG. 7) between opposite ends of: (i) the first projection 22, 22' and a first jam cleat 18, 54; (ii) each successive jam cleat (e.g., between jam cleats 18 and 16, and 16 and 14 of FIG. 3, and between jam cleats 52 and 54 of FIG. 7); and (iii) the last successive jam cleat 14, 52 and the second projection 20, 20'.

Therefore, as the flexible line 50 is guided through the cleat device 10, the axis 70 of the flexible line 50 forms an angles with respect to the longitudinal axis 72 of the cleat base 12 as the line passes between the jam cleats and projections of the cleat device 10, 10'.

The tighter the flexible line 50 is pulled after being guided through the jam cleats and projections, the tighter each individual jam cleat will impinge on and secure the flexible line 50 passing through its respective open end.

In an example embodiment of the invention, each of the jam cleats may have one open end as shown in FIGS. 1–4. In such an embodiment, open ends 15, 17, and 19 of adjacent jam cleats 14, 16, and 18 may be arranged opposite each other as shown in FIGS. 1–4.

Figure 8:
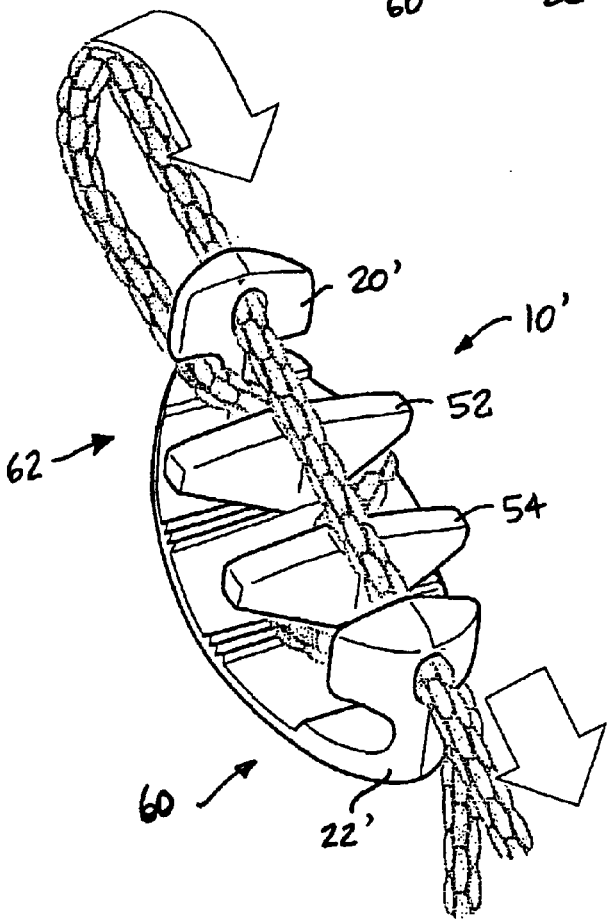
FIG. 8 shows a further perspective view of the cleat device of FIG. 5 with a flexible line guided therethrough.

In a further example embodiment of the invention as shown in FIGS. 5–8, the jam cleats 52, 54 may have two open ends (open ends 51 and 53 of jam cleat 52, and open ends 56 and 58 of jam cleat 54) which form acute angles. In such an embodiment, the flexible line 50 may be guided from the open end of one jam cleat to the oppositely facing open end of the next successive jam cleat (as shown in FIGS. 7 and 8).

In another example embodiment, a bore 24 may extend through each projection 20, 20'; 22, 22'. In such an embodiment, the method of cleating may further comprise guiding the flexible line 50 from the bore 24 in one projection over recesses 40 in a top portion of each of the jam cleats and through the bore 24 in the other projection. In such an embodiment, the recesses 40 may be approximately aligned with the bores 24. The recesses 40 may be semicircular.

In an alternate example embodiment of the invention, the flexible line 50 may be used to support one of a bay window or a bow window.

The flexible line 50 may be easily removed from the inventive cleat device 10 by removing the tag end of the line 50 from the bore(s) 24 and pulling the line 50 out of the successive jam cleats.

It should be appreciated that the cleat devices and methods of the present invention can easily accommodate varying sizes of flexible line 50, due to the acute angle of the open end of each jam cleat.

It should now be appreciated that the present invention provides advantageous cleat devices and methods for cleating where the tag end of the line is secured without extra hardware or tools.

Although the invention has been described in connection with various illustrated embodiments, numerous modifications and adaptations may be made thereto without departing from the spirit and scope of the invention as set forth in the claims.

What is claimed is:

1. A cleat device for a flexible line, comprising:

a base adapted for mounting on a surface;

a plurality of spaced apart jam cleats arranged on said base, each jam cleat having at least one open end forming an acute angle;

a projection extending from each end of said base outside of said plurality of jam cleats, a portion of at least one of said projections extending above said jam cleats and having an opening therein for a tag end of said line.

2. A cleat device in accordance with claim 1, wherein said opening comprises a bore through the respective projection.

3. A cleat device in accordance with claim 1, wherein:

each of said jam cleats has one open end; and said open ends of adjacent jam cleats are arranged opposite each other.

4. A cleat device in accordance with claim 1, wherein each of said projections comprises a hook-shaped arm.

5. A cleat device in accordance with claim 1, wherein:

said open end forming said acute angle comprises an upper face and a lower face;

at least one of said upper face or said lower face including at least one ridge thereon.

6. A cleat device in accordance with claim 1, wherein said jam cleats have two open ends which form acute angles.

7. A cleat device in accordance with claim 6, wherein said plurality of jam cleats comprises two jam cleats.

8. A cleat device in accordance with claim 1, wherein said plurality of jam cleats comprises at least three jam cleats.

9. A cleat device in accordance with claim 1, further comprising recesses in a top portion of said jam cleats and approximately aligned with said opening.

10. A cleat device in accordance with claim 9, wherein said recesses are semi-circular.

11. A cleat device in accordance with claim 1, wherein said jam cleats are arranged in parallel with each other on said base.

12. A cleat device in accordance with claim 1, wherein said cleat device is adapted for use in securing a cable support for one of a bay window or a bow window.

13. A method for cleating a flexible line, comprising:

(a) guiding said flexible line around a first projection extending from a first end of a cleat base;

(b) guiding said flexible line from said first projection around open ends of a plurality of spaced apart jam cleats arranged successively on said base, said open ends forming an acute angle;

(c) guiding said flexible line from a last successive jam cleat around a second projection extending from a second end of said cleat base;

(d) inserting said flexible line through an opening in at least one of said projections which extends above said jam cleats;

wherein said line is guided at an angle between opposite ends of: (i) said first projection and a first jam cleat; (ii) each successive jam cleat; and (iii) said last successive jam cleat and said second projection.

14. A method in accordance with claim 13, wherein said opening comprises a bore through the respective projection.

15. A method in accordance with claim 13, wherein:

each of said jam cleats has one open end; and said open ends of adjacent jam cleats are arranged opposite each other.

16. A method in accordance with claim 13, wherein each of said projections comprises a hook-shaped arm.

17. A method in accordance with claim 13, wherein:

said open end forming said acute angle comprises an upper face and a lower face;

at least one of said upper face or said lower face including at least one ridge thereon.

18. A method in accordance with claim 13, wherein said jam cleats have two open ends which form acute angles.

19. A method in accordance with claim 18, wherein said plurality of jam cleats comprises two jam cleats.

20. A method in accordance with claim 13, wherein said plurality of jam cleats comprises at least three jam cleats.

21. A method in accordance with claim 13, wherein a bore extends through each projection, further comprising:

guiding said flexible line from said bore in one projection over recesses in a top portion of each of said jam cleats and through said bore in said other projection, said recesses being approximately aligned with said bores.

22. A method in accordance with claim 21, wherein said recesses are semi-circular.

23. A method in accordance with claim 13, wherein said jam cleats are arranged in parallel with each other on said base.

24. A method in accordance with claim 13, wherein said flexible line is used to support one of a bay window or a bow window.

* * * * *